US005183241A

United States Patent [19]

Torisawa

[11] Patent Number: 5,183,241

[45] Date of Patent: Feb. 2, 1993

[54] SHEET FEEDING DEVICE FOR INVERTING A SHEET

[75] Inventor: Nobuyuki Torisawa, Minamiashigara, Japan

[73] Assignee: Fuji Photo Film Co., Ltd., Kanagawa, Japan

[21] Appl. No.: 800,107

[22] Filed: Nov. 29, 1991

[30] Foreign Application Priority Data

Nov. 29, 1990 [JP] Japan ..... 2-331954

[51] Int. Cl.[5] ..... B65H 5/00; B65H 29/00

[52] U.S. Cl. ..... 271/12; 271/225; 271/186; 271/902

[58] Field of Search ..... 271/3, 11, 12, 107, 271/186, 225, 902

[56] References Cited

U.S. PATENT DOCUMENTS

| | | | |
|---|---|---|---|
| 4,007,669 | 2/1977 | Achelpohl | 271/225 |
| 4,089,515 | 5/1978 | Stange et al. | 271/902 |
| 4,557,474 | 12/1985 | Davis et al. | 271/186 |
| 4,884,097 | 11/1989 | Giannetti et al. | 271/186 |
| 5,089,857 | 2/1992 | Xydias | 271/186 |

FOREIGN PATENT DOCUMENTS

| | | | |
|---|---|---|---|
| 2627810 | 1/1978 | Fed. Rep. of Germany . | |
| 54-51539 | 4/1979 | Japan . | |
| 130963 | 6/1987 | Japan | 271/225 |
| 214571 | 8/1989 | Japan | 271/225 |
| 1-242340 | 9/1989 | Japan . | |
| 163260 | 6/1990 | Japan | 271/186 |
| 784790 | 10/1957 | United Kingdom | 271/902 |
| 1599446 | 10/1981 | United Kingdom . | |

*Primary Examiner*—Robert P. Olszewski
*Assistant Examiner*—Steven M. Reiss
*Attorney, Agent, or Firm*—Sughrue, Mion, Zinn, Macpeak & Seas

[57] ABSTRACT

Disclosed herein is a device for feeding sheets one by one. This device basically comprises a suction pad moved toward stacked sheets so as to attract an uppermost sheet of the stacked sheets thereto, a drum rotatable in both forward and reverse directions, a first belt-type conveying system disposed on one part of the surface of the drum, a second belt-type conveying system disposed on another part of the surface of the drum, a sheet insertion port defined by the drum and the first belt-type conveying system, and a sheet withdrawal port defined by the drum and the second belt-type conveying system. The device is also characterized in that the suction pad is displaced to face the sheet insertion port so as to interpose the uppermost sheet between the drum and the first belt-type conveying system, followed by transfer toward the second belt-type conveying system, and the uppermost sheet is reversed by the drum and the second belt-type conveying system so as to be discharged from the sheet withdrawal port.

8 Claims, 3 Drawing Sheets

SHEET FEEDING DEVICE FOR INVERTING A SHEET

BACKGROUND OF THE INVENTION

1. Field of the Invention

The present invention relates to a device for feeding sheets one by one, of a type wherein an uppermost sheet of stacked sheets to be fed is held by conveying systems disposed around a rotatable drum and the sheet thus held is then reversed, thereby enabling the sheet to be delivered to another station.

2. Description of the Related Art

In order to withdraw sheets such as photographic light-sensitive mediums (e.g., a X-ray film, graphic art films etc.), one by one, from a supply magazine in which the sheets have been accommodated, so as to enable delivery of the sheets to succeeding stations (e.g., an exposure station, a development station, etc.), there is employed in a sheet feeding device, a suction cup or pad to be incorporated therein, which is coupled to a vacuum source. There is often a situation in which, for example, the uppermost sheet which has been attracted and held by the suction pad under suction, must temporarily be placed in a waiting state in the course of delivery along the path of the sheet feeding device, without being delivered directly to an automatic photographic processor, according to the purpose of its use.

Since suction tends to damage the surfaces of the sheets being fed, these sheets are accommodated in the supply magazine in a stacked state in such a manner that these surface coated with sensitive material of the sheets are usually directed downwards. There is therefore often a situation in which the surface of each of the sheets thus stacked must be turned over during transportation of the sheet in accordance with the type of the device.

FIG. 1 shows a conventional reversal mechanism for turning the sheet over. The reversal mechanism comprises a triangle-shaped guide 2 disposed in the course of transportation path of a sheet feeding device 1, pairs of rollers 3*a*, 3*c* disposed on both sides of the guide 2, pairs of rollers 3*b*, 3*d* disposed above the guide 2, and standby port 4 and a guide plate 5 both located above the guide 2.

The reversal mechanism is activated in the following manner. A sheet e.g., a photographic film F, having a surface coated with a sensitive material facing downwards, is attracted under suction by a suction cup or pad 6 so as to be fed toward the guide 2 and transported upwards along one of slanted surfaces of the guide 2. Thereafter, the photographic film F is transported to the standby port 4 so as to be held between the paired rollers 3*d*. Then, the guide 2 is moved toward the left side as viewed in FIG. 1, and the leading end of the photographic film F, which has been held by the rollers 3*d*, is moved along the other of the slanted surfaces of the guide 2, followed by the transportation of the film F toward an automatic photographic processor as a next step via a conveying system 8 including drums or the like, whereby the light-sensitive layer of the sheet can be oriented upwards, thereby reversal operation by the reversal mechanism is completed.

In the sheet feeding device 1, however, the photographic film F must temporarily be held at the standby port 4 disposed in the transportation path of the film F. Thus, when a photographic film having large dimension is used, the space of the standby port 4 for receiving this photographic film therein becomes large to meet the size of the film F, so that the sheet feeding device 1 itself also becomes larger in size. When sheets having inferior quality or shape, e.g., curled sheets, are used, the curled portions of the sheets abut against the rollers 3*b* near the standby port 4 disposed above the guide 2, so that the sheets cannot be introduced into the standby port 4.

SUMMARY OF THE INVENTION

With the foregoing shortcomings in view, it is a principal object of the present invention to provide a sheet feeding device of a type wherein a first belt-type conveying system and a second belt-type conveying system are disposed around a drum rotatable in both forward and reverse directions on which a sheet is wound and held, followed by turning the surface of the sheet over, thereby enabling the sheet to be fed to an automatic photographic processor or the like.

It is another object of the present invention to provide a device for feeding sheets one by one, comprising a suction pad moved towards stacked sheets so as to attract an uppermost sheet thereto, a drum rotatable in both forward and reverse directions, a first belt type conveying system disposed on one part of the surface of the drum, a second belt-type conveying system disposed on another part of the surface of the drum, a sheet insertion port defined by the drum and the first belt-type conveying system, and a sheet withdrawal port defined by the drum and the second belt-type conveying system, the arrangement being such that the suction pad is displaced to face the sheet insertion port so as to insert the sucked uppermost sheet between the drum and the first belt-type conveying system, followed by transfer toward the second belt-type conveying system, and the uppermost sheet is reversed by the drum and the second belt-type conveying system so as to be discharged from the sheet withdrawal port.

It is a further object of the present invention to provide a device wherein the first and second belt-type conveying systems are disposed to be brought into contact with the outer periphery of the drum.

It is a still further object of the present invention to provide a device wherein the uppermost sheet is held by at least either the drum and the first belt type conveying system or the drum and the second belt-type conveying system.

It is a still further object of the present invention to provide a device wherein each of the first belt-type conveying system has a first detecting means and the second belt-type conveying system has a second detecting means for detecting the uppermost sheet.

It is a still further object of the present invention to provide a device wherein the detecting means comprises a roller displaced in response to the insertion of the uppermost sheet into the sheet insertion port, for detecting the uppermost sheet.

It is a still further object of the present invention to provide a device wherein the drum rotates n the reverse direction when the second detecting means detects the tailing end of the sheet to transfer the sheet to a succeeding station from the withdrawal port.

It is a still further object of the present invention to provide a device wherein the device comprises a sheet detecting means for detecting plural sheet feeding.

It is a still further object of the present invention to provide a device wherein the device comprises a sheet pressing means for pressing an edge part of the sheet.

The above and other objects, features and advantages of the present invention will become apparent from the following description and the appended claims, taken in conjunction with the accompanying drawings in which a preferred embodiment of the present invention is shown by way of illustrative example.

DETAILED DESCRIPTION OF REFERRED EMBODIMENTS

Figure 1:
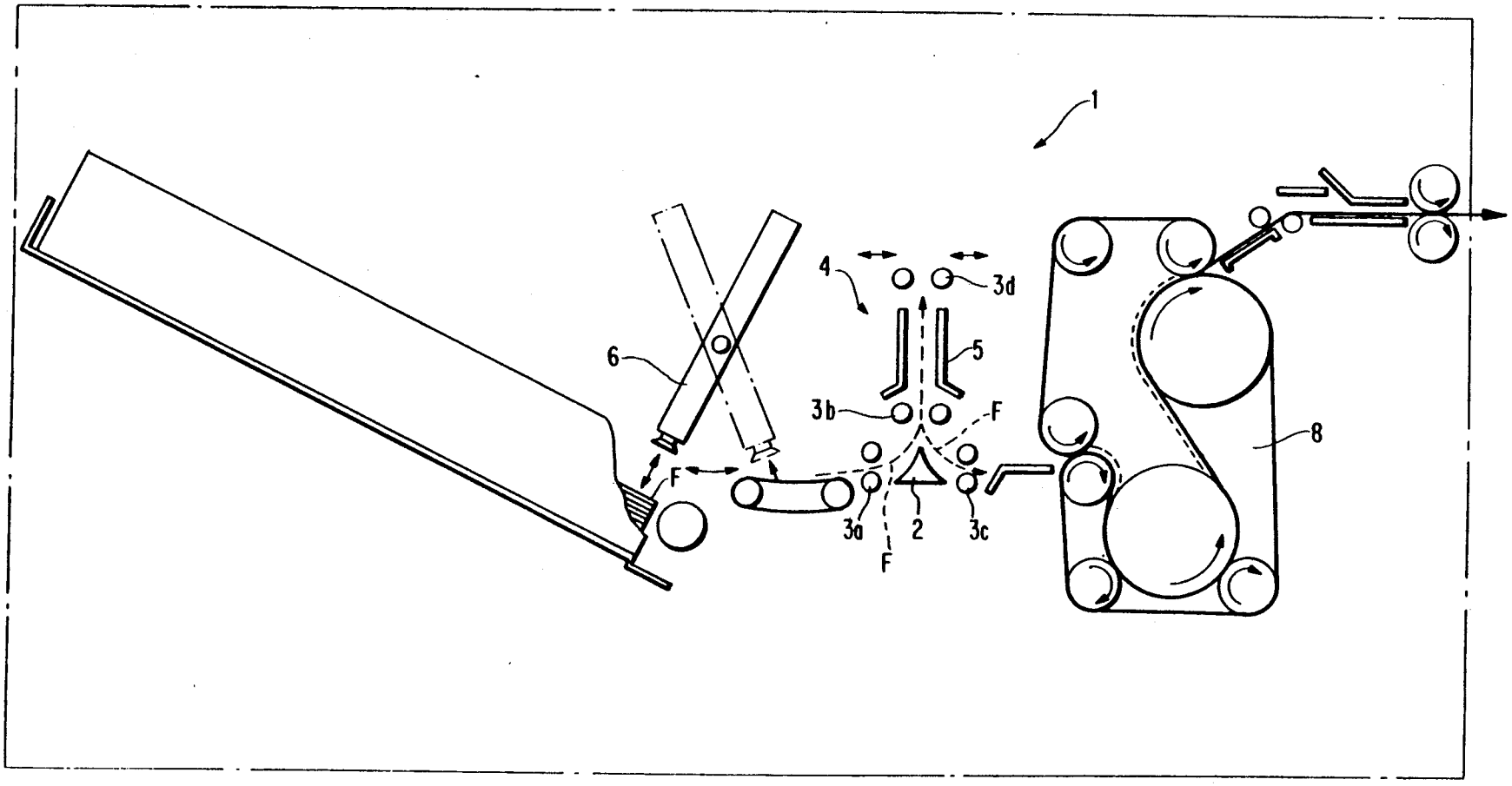
FIG. 1 PRIOR ART
FIG. 1 is a vertical cross-sectional view schematically showing a conventional sheet feeding device.
Figure 2:
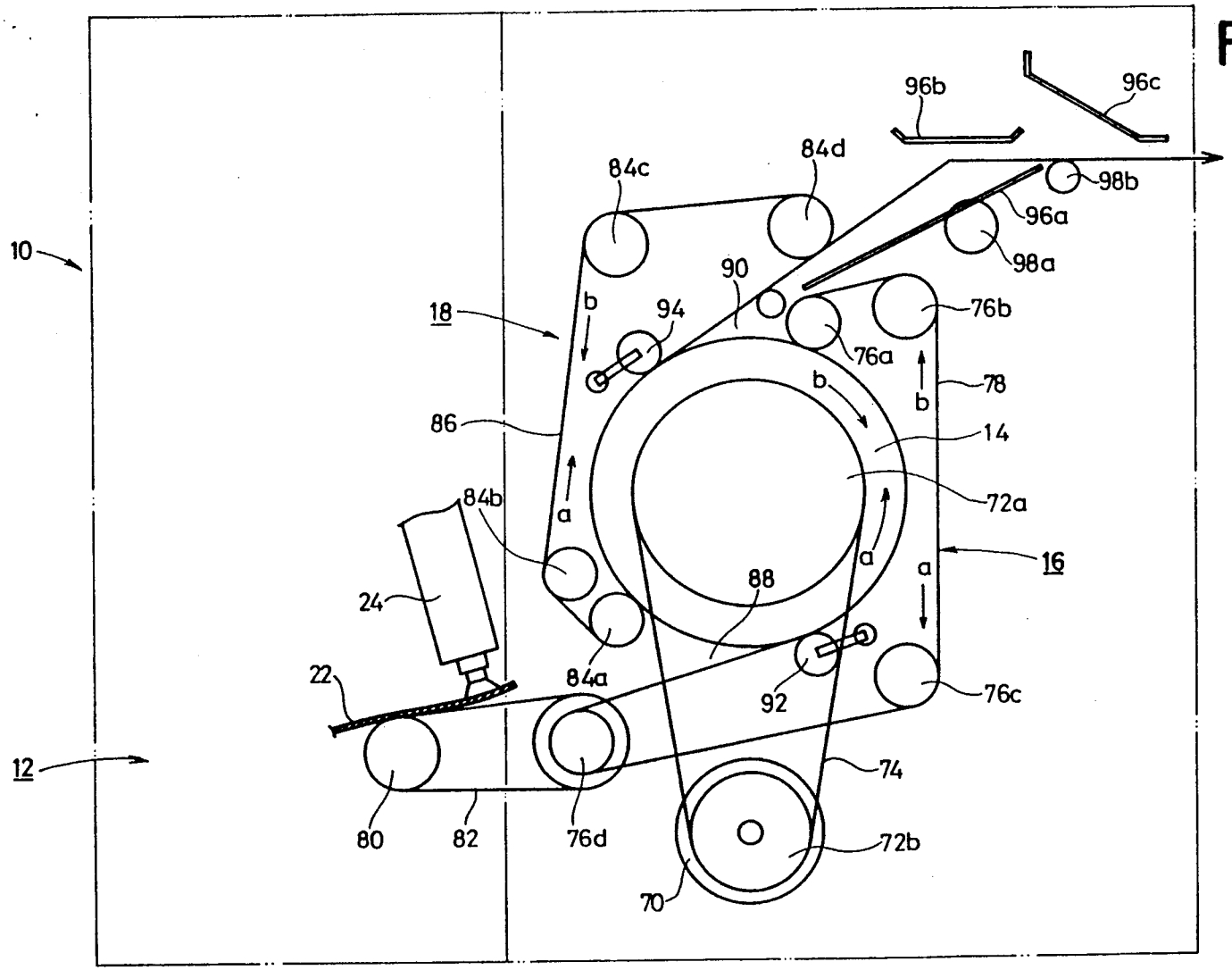
FIG. 2 is a vertical cross-sectional view schematically illustrating a sheet feeding device according to one embodiment of the present invention.

Referring to FIG. 2, designated at numeral 10 is a sheet feeding device according to one embodiment of the present invention. The sheet feeding device 10 basically comprises a suction mechanism 12 for attracting and holding sheets, one by one, from a stack of sheets transfer to a succeeding station, a first belt-type conveying system 16 disposed on one part of the surface of a drum 14, rotatable in both forward and reverse directions and a second belt-type conveying system 18 disposed on another part of the surface of the drum 14.

Figure 3:
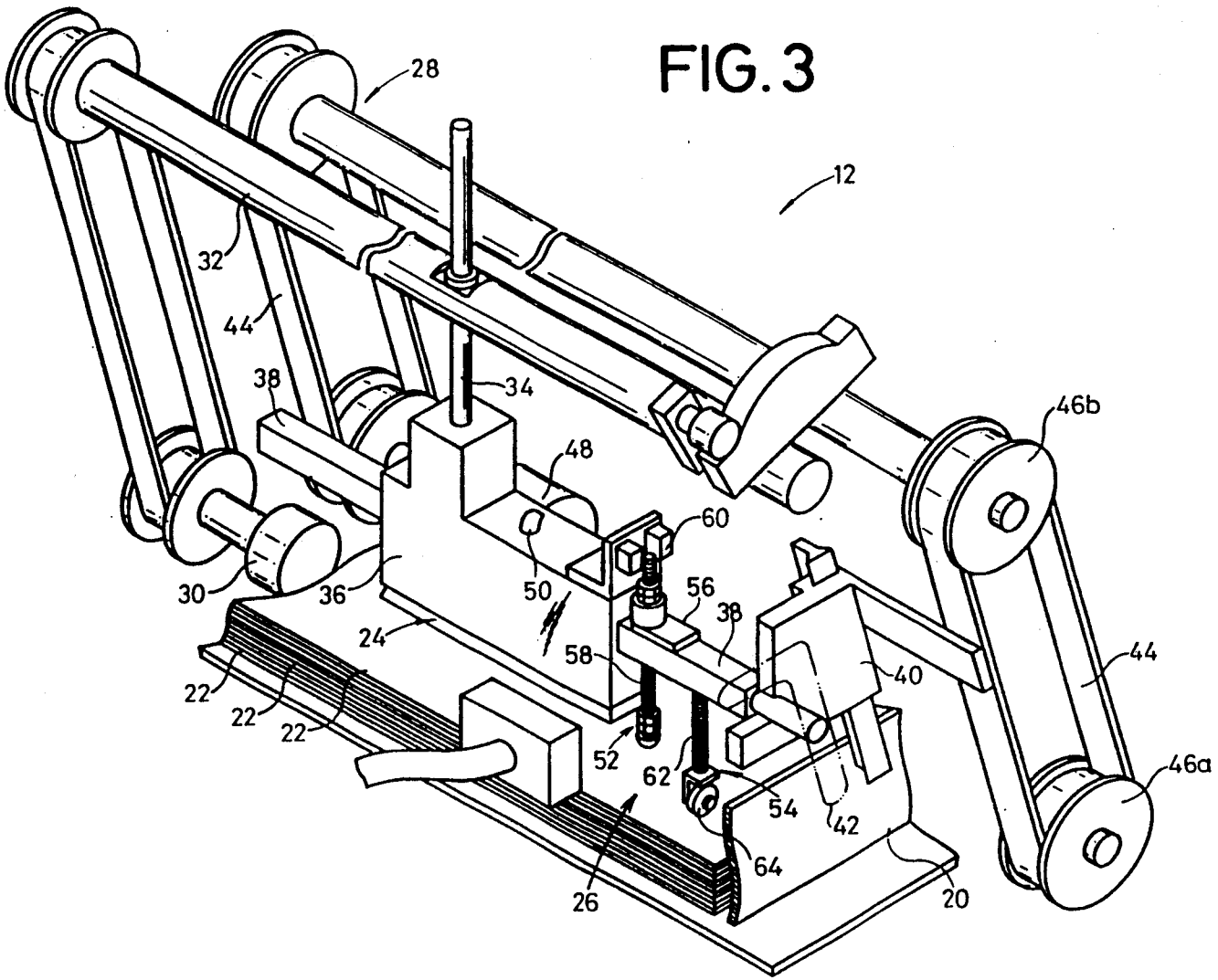
FIG. 3 is a schematic perspective view of a suction mechanism.

As shown in FIG. 3, the suction mechanism 12 comprises a suction cup or pad 24 for successively attracting and holding photographic light-sensitive mediums 22 as sheets, which are stacked in a supply magazine 20, and a sheet pressing means 26, disposed in the vicinity of the suction pad 24, for pressing an edge part of an uppermost sheet of the stacked photographic light-sensitive mediums 22. A supply magazine 20 is used in the present embodiment. However, the present invention is not necessarily limited to such a supply magazine 20 but any structure of which can stack and place sheets therein can also be used.

The suction pad 24 and the sheet pressing means 26 are displaceable in unison with each other by a drive means 28. The suction pad 24 is supported by a holder 36 fixedly mounted on a guide bar 34 which is slidably inserted into a rotatable shaft 32 coupled to a rotative drive source 30, and a rod 38 horizontally supported by the holder 36.

The both ends of the rod 38 are inserted into respective guide grooves 42 by way of support plates 40, and one end of the support plate 40 is fixed to one of belts 44. In addition, the belts 44 are wound between pairs of pulleys **46*a*, 46*b*, with one pair of pulleys 46*a*, 46*b* being coupled to a rotative drive source 48. The holder 36 has a pipe 50 one end of the pipe 50 being communicated with an unillustrated vacuum source and another end being communicated with the suction pad 24**.

The sheet pressing means 26 comprises a sheet detecting means 52 disposed near the suction pad 24, for detecting plural sheet feeding from the stacked photographic light-sensitive mediums 22, and a sheet pressing member 54. The sheet detecting means 52 comprises a seat 56 fixedly mounted on the rod 38, detecting rod 58 supported by the seat 56, and a sensor 60. The sheet pressing member 54 has a rod member which is urged to move toward the stacked photographic light-sensitive mediums 22 under the bias of a coiled spring 62 disposed around the rod member which is movably supported on the rod 38, and a roller 64 for pressing the photographic light-sensitive medium 22 which has been attracted and held by the suction pad 24.

As shown in FIG. 2, there is provided a conveying mechanism connecting to the suction mechanism 12 so as to deliver an uppermost photographic light-sensitive medium 22 taken out from the supply magazine 20 toward a withdrawal port. The drum 14 of the conveying mechanism is shaped in the form of a cylinder and has a smoothed surface. It is preferable that the circumferential length of the drum 14, is the same as that of a sheet to be fed or more. However, the circumferential length of drum 14 is not necessarily limited thereto. In addition, there is disposed below the drum 14, a rotative drive source 70 rotatable in the both forward and backward directions. A belt 74 is wound between a pulley **72*a* mounted to the shaft of the drum 14 and a pulley 72*b* mounted to the shaft of the rotative drive source 70** respectively.

On one part of the surface of the drum 14, a belt 78 is wound among a plurality of rollers **76*a* through 76*d* disposed around the drum 14 so as to constitute the first conveying system 16. In order to reliably receive the photographic light-sensitive medium 22 fed from the suction mechanism 12, a sub belt 82 is wound between the roller 76*d* of the first conveying system 16 and a roller 80 at the side of the suction mechanism 12, respectively. In the same manner as described above, on another part of the surface of the drum 14 as well, a belt 86 is wound among a plurality of rollers 84*a* through 84*d* disposed around the drum 14 so as to constitute the second conveying system 18**.

An insertion port 88 is formed between the first conveying system 16 and a location near the upstream side of the drum 14, whereas a withdrawal port 90 is formed between the second conveying system 18 and a location near the downstream side of the drum 14. A first detector 92 including a roller angularly displaceable in response to the insertion of the photographic light-sensitive medium 22 into the first conveying system 16 near the insertion port 88, is disposed so as to be brought into contact with the drum 14. The first detector 92 includes a roller supported by an arm whose one end fixedly supported. Similarly to the arrangement of the first detector 92, a second detector 94 including a roller angularly displaced in response to the insertion of the photographic light-sensitive medium 22 into the second conveying system 18 near the withdrawal port 90, is disposed so as to be brought into contact with the drum 14. There is also disposed near the withdrawal port 90, a plurality of guide plates **96*a* through 96*c* and rollers 98*a*, 98*b*, all of which serve to introduce a sheet, e.g., a photographic light-sensitive medium 22** into an unillustrated automatic photographic processor.

The operation of the sheet feeding device constructed as described above will now be described below.

After the supply magazine 20 has been loaded in the sheet feeding device 10, the rotative drive source 48 is energized to cause the pulleys **46*a*, 46*b* and the belt 44 to displace the rod 38 toward the supply magazine 20, thereby causing the suction pad 24 to approach the opposite surface to the surface coated with light-sensitive material of a photographic light-sensitive medium 22. At this time, the sheet detecting means 52 detects that the suction pad 24 has reached a predetermined position with respect to the photographic light-sensitive medium 22, thereby de-energizing the rotative drive source 48**.

The suction pad 24 starts to suck an uppermost photographic light sensitive medium 22 at a predetermined vertical position to attract the uppermost photographic light-sensitive medium 22 before the suction pad presses the stack of the photographic light-sensitive medium 22, so that the uppermost photographic light-sensitive medium 22 is attracted and held under suction.

Then, the rotative drive source 48 is reversed to move the rod 38 away from the supply magazine 20. At this time, the sheet pressing member 54 presses the side edge of the photographic light-sensitive medium 22 downwards to prevent a plural sheet feeding, and the sheet detecting means 52, which also abuts against the edge part of the photographic light-sensitive medium 22, is activated to detect whether or not a plurality of photographic light-sensitive mediums 22 has been attracted based upon the stiffness or the rigidity of the photographic light-sensitive medium 22 itself. If a plurality of photographic light-sensitive mediums 22 is attracted and held by the suction pad 24, then the suction pad 24 is lifted and lowered to leave only the uppermost photographic light-sensitive medium 22 on the suction pad 24. Accordingly, the photographic light-sensitive mediums 22 can reliably and efficiently be fed one by one.

When the suction pad 24 reaches a predetermined position under the operation of the rotative drive source 48, the rotative drive source 48 is de-energized, and the rotative drive source 30 is energized to cause the rotatable shaft 32 to turn the rod 38 in a given angular range, thereby feeding the photographic light-sensitive medium 22 attracted and held by the suction pad 24 toward the sub-belt 82. As a consequence, the suction pad 24 is inactivated, releasing the photographic light-sensitive medium 22.

The leading end of the photographic light-sensitive medium 22 is interposed between the first conveying system 16 and the drum 14 which have been rotated in the direction indicated by the arrow "a" in FIG. 2, after which it is guided toward the drum 14. Thus, as soon as the leading end of the photographic light-sensitive medium 22 passes through the first detector 92, the first detector 92 detects that the photographic light-sensitive medium 22 has been inserted into the conveying mechanism. On the other hand, after the tailing end of the photographic light-sensitive medium 22 moved along the drum 14 has passed through the first detector 92 and the second detector 94 disposed in the second conveying system 18, the second detector 94 does not detect the presence of the photographic light-sensitive medium 22. Therefore, the rotative drive source 70 is immediately de-energized in response to a detected signal from the second detector 94. Accordingly, the photographic light-sensitive medium 22 is supported between the drum 14 and the second conveying system 18 of another part of the surface of the drum 14.

Taking into consideration the dimensions of the photographic photosensitive medium 22, the rotative drive source 70 may not be de-energized when the tailing end of the photographic photosensitive medium 22 passes through the second detector 94 in the second conveying system 18 but may be de-energized when the tailing end of the photographic light-sensitive medium 22 passes through the first detector 92 in the first conveying system 16 so that the photographic light-sensitive medium 22 is supported between the other part of the surface of the drum 14 and the first conveying system 16.

Despite the curled leading end of the photographic light-sensitive medium 22 or the thickness of the photographic light-sensitive medium 22, the photographic light-sensitive medium 22 is interposed and transported between the drum 14 and each of the belts of the first and second conveying systems 16, 18. It is therefore unnecessary to deactivate the sheet feeding device 10 when the photographic light-sensitive medium 22 is curled.

Then, the drum 14 is reversed as indicated by the arrow "b" in FIG. 2 so as to discharge the photographic light-sensitive medium 22 from the tailing end thereof from the withdrawal port 90 of the drum 14. At this time, the photographic light-sensitive medium 22 is turned over. After the tailing end of the photographic light-sensitive medium 22 has been released from the second conveying system 18, the photographic light-sensitive medium 22 is introduced among the guide plates **96*a*, 96*b* and 96*c* along the belt 86 of the second conveying system 18 to feed to the unillustrated automatic photographic processor. The surface of the photographic photosensitive medium 22 attracted under suction by the suction pad 24, is turned over by the drum 14 and the first and second conveying systems 16, 18**.

The sheet feeding device according to the present invention, as has been described above, can bring about the following advantageous effects.

Since a drum rotatable in both forward and reverse directions is provided and first and second conveying systems are respectively disposed on different parts of the surface of the drum, the sheet feeding device itself can be rendered small. In addition, the front and back surfaces of each sheet attracted and held by a suction pad can easily be reversed because the sheet is withdrawn from the tailing end of the sheet from the withdrawal port after the sheet has been wound around the drum. Each sheet, which has been attracted and held by the suction pad, is introduced into the insert port defined by the first conveying system and the drum, where the sheet is held by a belt of the first conveying system and a roller, thereby making it possible to smoothly reverse each sheet irrespective of the type of the sheet and even through each sheet has different thickness or is curled.

Having now fully described the invention, it will be apparent to those skilled in the art that many changes and modifications can be made without departing from the spirit or scope of the invention as set forth herein.

What is claimed is:

1. A device for feeding sheets one by one, comprising:

a suction pad movable towards stacked sheets so as to attract an uppermost sheet thereto;

a drum rotatable in both forward and reverse directions;

a means for rotating said drum in said forward and reverse directions;

means for changing the rotation of said drum from said forward direction to said reverse direction when said uppermost sheet has reached a predetermined position in said device;

a first belt-type conveying system disposed on one part of the surface of said drum;

a second belt-type conveying system disposed on another part of the surface of said drum;

a sheet insertion port defined by said drum and said first belt-type conveying system; and a sheet withdrawal port defined by said drum and said second belt-type conveying system;

the arrangement being such that said suction pad is displaced to face said sheet insertion port so as to interpose said uppermost sheet between said drum and said first belt-type conveying system, followed by a transfer toward said second belt-type conveying system and a subsequent discharge of said uppermost sheet in a reversed position from said sheet withdrawal port upon reverse rotation of said drum by said rotating means in response to said means for changing the rotation.

2. A device according to claim 1, wherein said first and second belt-type conveying systems are disposed to be brought into contact with the outer periphery of said drum.

3. A device according to claim 1, wherein said uppermost sheet is held by at least either said drum and said first belt-type conveying system or said drum and said second belt-type conveying system.

4. A device according to claim 1, wherein said first belt-type conveying system has a first detecting means and said second belt-type conveying system has a second detecting means, each for detecting said uppermost sheet.

5. A device according to claim 4, wherein said first detecting means comprises a roller displaced in response to the insertion of said uppermost sheet into said sheet insertion port and said second detecting means comprises a roller displaced in response to the insertion of said uppermost sheet into the second belt-type conveying system, said second detecting means forming a portion of said means for changing the rotation.

6. A device according to claim 4, wherein said means for changing rotation includes means for causing the drum to rotate in the reverse direction when said second detecting means detects the tailing end of said uppermost sheet to transfer said uppermost sheet to a succeeding station from said withdrawal port.

7. A device according to claim 1, wherein the device further comprises a sheet detecting means for detecting plural sheet feeding.

8. A device according to claim 7, wherein the device further comprises a sheet pressing means for pressing an edge part of said sheet.

* * * * *